US012285703B2

(12) United States Patent
Petrarca et al.

(10) Patent No.: US 12,285,703 B2
(45) Date of Patent: Apr. 29, 2025

(54) BUBBLE MACHINE WITH MULTIPLE BUBBLE MAKING PORTS

(71) Applicant: Little Kids, Inc., Seekonk, MA (US)

(72) Inventors: Michael Petrarca, Chepachet, RI (US); Michael Fusco, Greenville, RI (US)

(73) Assignee: Little Kids, Inc., Seekonk, MA (US)

( * ) Notice: Subject to any disclaimer, the term of this patent is extended or adjusted under 35 U.S.C. 154(b) by 176 days.

(21) Appl. No.: 18/162,005

(22) Filed: Jan. 31, 2023

(65) Prior Publication Data

US 2023/0241527 A1 Aug. 3, 2023

Related U.S. Application Data

(60) Provisional application No. 63/305,399, filed on Feb. 1, 2022.

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS 5,498,191 A 3/1996 DeMars
5,613,890 A * 3/1997 DeMars ..... A63H 33/28 446/15
6,200,184 B1 3/2001 Rich et al.
6,331,130 B1 * 12/2001 Thai ..... A63H 3/003 446/16
6,659,830 B2 12/2003 Thai
7,086,612 B2 8/2006 Crawford
7,144,291 B2 12/2006 Thai
7,780,497 B2 8/2010 Thai
8,123,584 B2 * 2/2012 Thai ..... A63H 33/28 446/16
8,636,557 B2 1/2014 Lo
8,794,600 B2 8/2014 Chou
8,888,549 B2 * 11/2014 Lo ..... A63H 33/28 446/16
9,339,737 B2 5/2016 Chan
9,757,661 B2 9/2017 Chan
9,884,262 B2 2/2018 Huey
10,350,507 B2 7/2019 Yang
(Continued)

*Primary Examiner* — John A Ricci
(74) *Attorney, Agent, or Firm* — Hinckley, Allen & Snyder, LLP; David R. Josephs

(57) ABSTRACT

The present invention includes a plurality of soap bubble making ports in a housing where each of the ports includes a ring-shaped soap bubble outlet. A single tube, via the pump, pulls soap bubble solution from the reservoir and, through a manifold, delivers soap bubble solution to the output ports of the manifold and then to each of the plurality of soap bubble making ports. A plurality of mechanically linked wipers is respectively located at each soap bubble making port to form a film at the soap bubble making port. An air manifold splits air received from the air blower respectively to each soap bubble making port. When a motor-driven shaft rotates, soap bubble solution is delivered to all soap bubble ports; causes all wipers to rotate and causes air to be blown through all of the soap bubble ports to creates multiple soap bubbles at the same time.

16 Claims, 14 Drawing Sheets

(56) References Cited

U.S. PATENT DOCUMENTS

| | | | | |
|---|---|---|---|---|
| 10,363,492 | B1 | 7/2019 | Thai | |
| 10,434,433 | B1 * | 10/2019 | Thai | A63H 33/28 |
| 10,434,434 | B1 * | 10/2019 | Thai | A63H 29/22 |
| 10,500,520 | B2 | 12/2019 | Pogue et al. | |
| 10,702,788 | B2 | 7/2020 | Thai | |
| 10,780,365 | B2 | 9/2020 | Shapiro et al. | |
| 10,807,015 | B2 | 10/2020 | Chan | |
| 10,814,243 | B2 | 10/2020 | Clayton et al. | |
| 2004/0142626 | A1 * | 7/2004 | Choi | A63H 33/28 446/15 |
| 2004/0155058 | A1 | 8/2004 | Dunham et al. | |
| 2012/0214378 | A1 * | 8/2012 | Lo | A63H 33/28 446/15 |
| 2012/0220184 | A1 | 8/2012 | Orem et al. | |
| 2018/0221784 | A1 | 8/2018 | Huey | |
| 2020/0155957 | A1 | 5/2020 | Clayton et al. | |
| 2020/0155958 | A1 | 5/2020 | Shapiro et al. | |
| 2020/0406158 | A1 | 12/2020 | Chan | |
| 2021/0001241 | A1 | 1/2021 | Clayton et al. | |
| 2023/0055009 | A1 * | 2/2023 | Lo | A63H 33/28 |
| 2024/0197828 | A1 * | 6/2024 | Wang | A61K 38/1709 |

* cited by examiner

BUBBLE MACHINE WITH MULTIPLE BUBBLE MAKING PORTS

CROSS REFERENCE TO RELATED APPLICATION

This application is related to, and claims benefit from, U.S. Provisional Application No. 63/305,399, filed on Feb. 1, 2022, entitled "BUBBLE MACHINE WITH MULTIPLE BUBBLE MAKING PORTS," incorporated by reference in its entirety, herein.

BACKGROUND OF THE INVENTION

The invention is in the field of motor driven, soap bubble producing toys.

Motor driven, soap bubble producing toys have been around for many years. Typically, such toys have a soap bubble solution reservoir, a motive power source, for example, a battery, a motor, a pump, a soap bubble solution feed tube, and a soap bubble forming structure, such as a wand or wand-like circular aperture for forming the soap bubbles.

In the prior art, these soap bubble producing toys commonly include a soap bubble ring that is dipped into soap bubble solution and then exposed to an air stream to form the soap bubbles. Other known soap bubble producing devices and machines commonly include a wiper or a swiper, such as in the form of a wire or blade, that travels across a soap bubble aperture coating it with soap bubble solution to form a film which is then exposed to an air stream to create the soap bubble.

Both of these existing mechanisms have drawbacks. These prior art devices, machines and mechanisms typically only include a single soap bubble aperture for creating one supply of soap bubbles. However, the volume of soap bubbles created is inherently limited when only one soap bubble creation portion is provided. In the former prior art example of a ring that is dipped into soap bubble solution, volume of soap bubbles than can be produced is increased by providing more rings that can be dipped into a one or more soap bubble solution troughs by the machine, either simultaneously or sequentially. In other words, more soap bubble creation rings, and more soap bubble solution troughs can be provided in the same machine so it can create more soap bubbles.

On the other hand, it is more difficult to increase the volume of soap bubbles created by soap bubble making machines that use some type of wiping structure because each soap bubble making port must receive a supply of soap bubble solution so that it can be wiped across the soap bubble making opening. To keep costs of manufacture as low as possible, including a separate motor, soap bubble solution supply and pump and air blower for each soap bubble producing port is not feasible. Therefore, such soap bubble making machines 10 of the prior art that employ a wiper 12 typically have only a single soap bubble making port 14 and a single corresponding wiper 12 as seen in the prior art of FIG. 1. Providing only a single supply of soap bubbles 16 inherently limits the volume of soap bubbles that can be created with a given prior art machine 10.

As can be seen in prior art FIG. 1, solution is introduced onto a ring 16 with a collection trough 18 where the wiper 16 swipes across the surface thereof to create a film of soap bubble solution. Air is then blown outwardly through an aperture port 14 to form the desired soap bubble 16. Continuous feed of soap bubble solution to the ring 16, continuous rotation of the wiper 12 to create a film of soap bubble solution and continuous blowing of air creates a continuous formation of soap bubbles 16 from the single soap bubble blowing port 14, as shown.

Also, it is common for the single mechanical wiper mechanism of the prior art of FIG. 1 to be driven indirectly by the same motor that is driving the pump for the solution and the blower. However, it is desirable for more than one soap bubble port 14 and wiper mechanism 12 to be provided in this type of device 10 as well to increase the volume of soap bubbles 16 that this machine 10 can deliver.

Incorporating more than one such soap bubble creation port with more than one corresponding wiper in a single soap bubble making machine for providing a larger volume of soap bubble is desired.

There is a need for a soap bubble machine that has a soap bubble solution manifold that can deliver soap bubble solution from one reservoir to more than one soap bubble making ports simultaneously.

There is a need for a soap bubble machine that mechanically links rotation of respective wipers associated with the more than one soap bubble ports.

There is a need for a soap bubble machine that can blow air to more than one soap bubble making port that has been wiped and provided with soap bubble solution across the opening thereof for the creation of soap bubbles at all soap bubble ports simultaneously.

Accordingly, there is a need for an improved soap bubble producing mechanism that can be used with motor driven soap bubble producing toys.

SUMMARY OF THE INVENTION

The invention provides an improved mechanism for producing soap bubbles in a motor driven soap bubble producing toy. The mechanism is a soap bubble generating assembly that automatically forms a soap bubble film over the more than one soap bubble port after it has been wiped by a wiper mechanism.

The present invention includes a plurality of soap bubble making ports in a housing where each of the ports includes a ring-shaped soap bubble outlet. A single tube, via the pump, pulls soap bubble solution from the reservoir and, through a manifold, such as a single input to three output manifold, delivers soap bubble solution to multiple output tubes respectively connected to the output ports of the manifold so soap bubble solution is simultaneously delivered to each of the plurality of soap bubble making ports. A plurality of mechanically linked wipers is respectively located at each soap bubble making port to form a film at the soap bubble making port. An air manifold splits air received from the air blower respectively to each soap bubble making port. When a motor-driven shaft rotates, soap bubble solution is delivered to all soap bubble ports; causes all of the wipers to rotate and causes air to be blown through all of the soap bubble ports to creates multiple soap bubbles at the same time. It is also possible that a singular, centrally mounted wiper or swiper is provided to rotated over all of the, for example three, soap bubble ports in a circular fashion. Such an embodiment can avoid additional linkages and mechanical component for multiple wipers to simplify and lower the cost of the machine.

Therefore, an object of the present invention is to provide a soap bubble machine with more than one soap bubble creation port with more than one corresponding wiper in a single soap bubble making machine for providing a larger volume of soap bubble is desired.

There is a further object of the invention to provide a soap bubble machine that has a soap bubble solution manifold, such as a single input to multiple (e.g. three) output manifold, that can deliver soap bubble solution from a single reservoir to more than one soap bubble making ports simultaneously to greatly increase soap bubble production.

There is yet a further object of the present invention to provide a soap bubble machine that mechanically links rotation of all the respective wipers associated with the more than one soap bubble port.

Another object of the present invention is to provide a soap bubble machine that can simultaneously blow air through more than one soap bubble making port that has been wiped and provided with soap bubble solution across the opening thereof for the creation of soap bubbles at all soap bubble ports simultaneously.

A further object of the present invention is to provide an improved soap bubble producing mechanism that can be used with motor driven soap bubble producing toys.

Other objects, features and advantages of the invention shall become apparent as the description thereof proceeds when considered in connection with the accompanying illustrative drawings.

BRIEF DESCRIPTION OF THE DRAWING FIGURES

The novel features that are characteristic of the present invention are set forth in the appended claims. However, the invention's preferred embodiments, together with further objects and attendant advantages, will be best understood by reference to the following detailed description taken in connection with the accompanying Figures in which:

DESCRIPTION OF THE INVENTION

The new and unique soap bubble machine 100 with multiple soap bubble ports 102 with respective multiple wipers 104 and blowing ports is described in detail below. The soap bubble machine 100 of the present invention is shown in detail in FIGS. 2-16.

Figure 1:
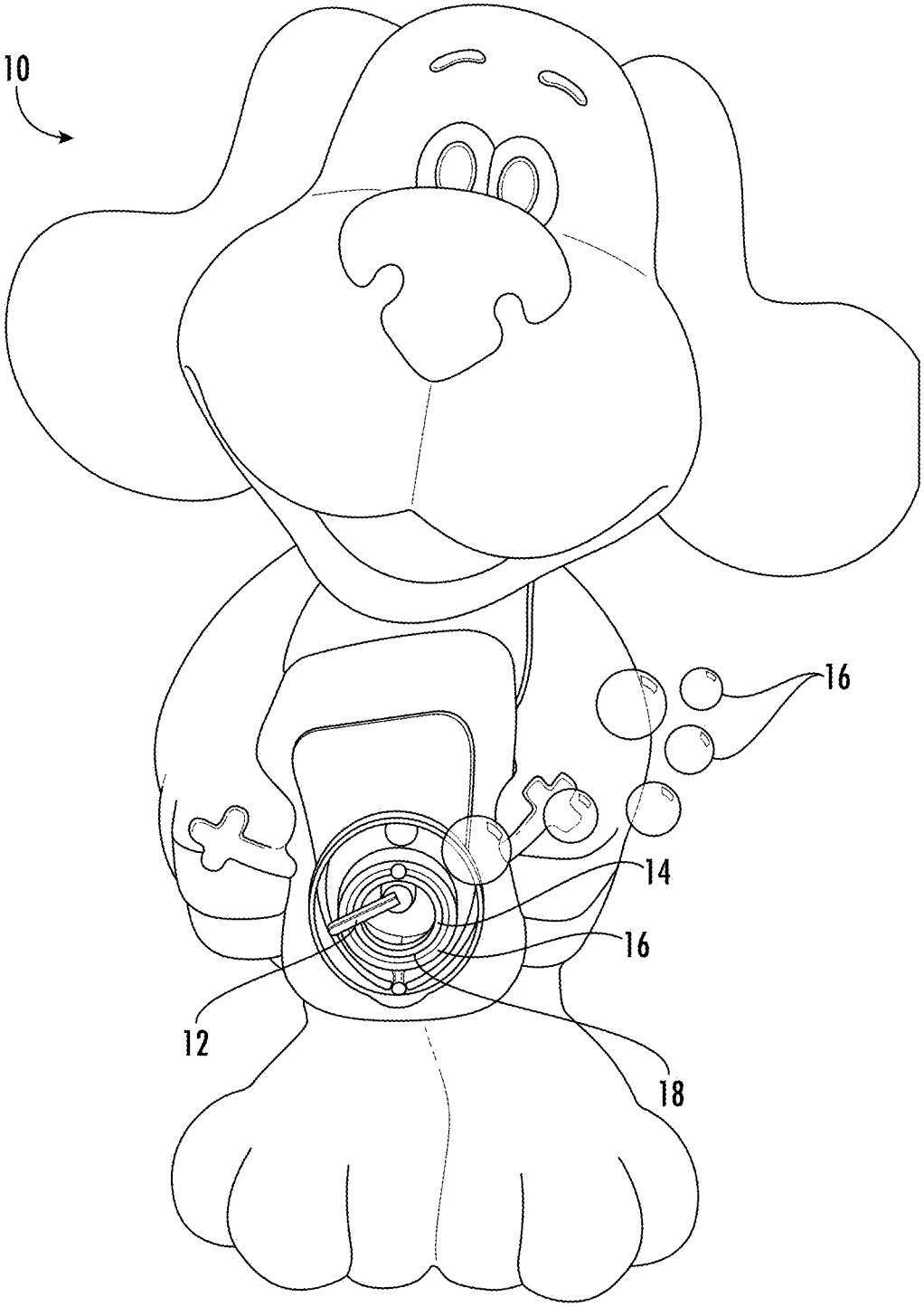
FIG. 1 (PRIOR ART)
FIG. 1 shows a perspective view of a prior art soap bubble machine with a single soap bubble creating port with a respective single wiper and respective single blowing port.
Figure 2:
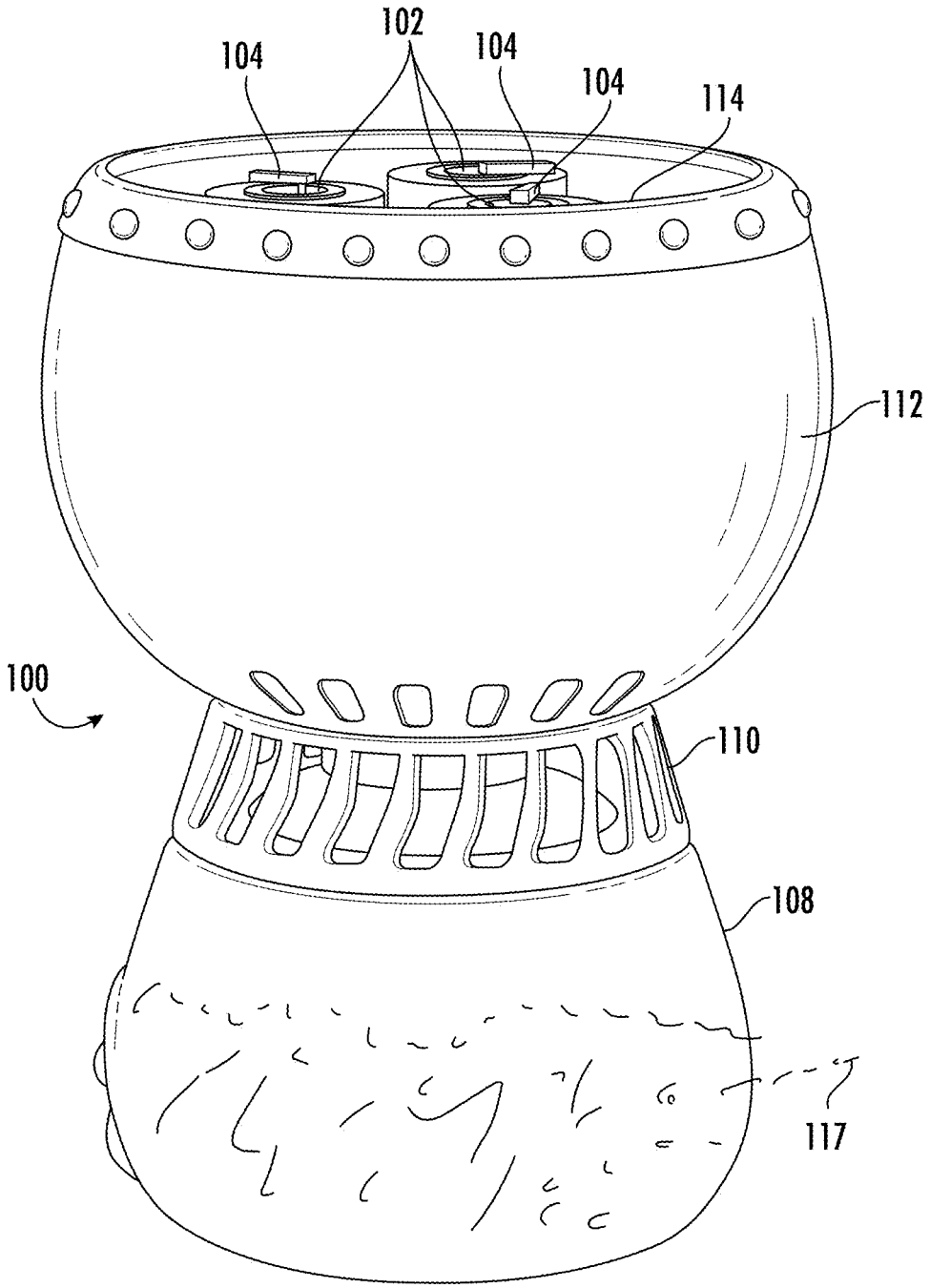
FIG. 2 shows a second embodiment of the multi-port soap bubble blowing machine in accordance with the present invention.

Referring first to FIG. 2, a top front perspective view of the multi-port soap bubble blowing machine 100 in accordance with the present invention is shown. The present soap bubble machine 100 is preferably of horizontal configuration but also could be vertically positioned in similar fashion to the prior art of FIG. 1. Unlike the prior art of FIG. 1, the present invention of FIG. 2 includes more than one (e.g., three) soap bubble blowing ports, each with their own wiper and feed of soap bubble solution. The machine 100 includes a bubble solution reservoir 108, vent intake 110 and upper housing 112 with a top plate 114.

Figure 3:
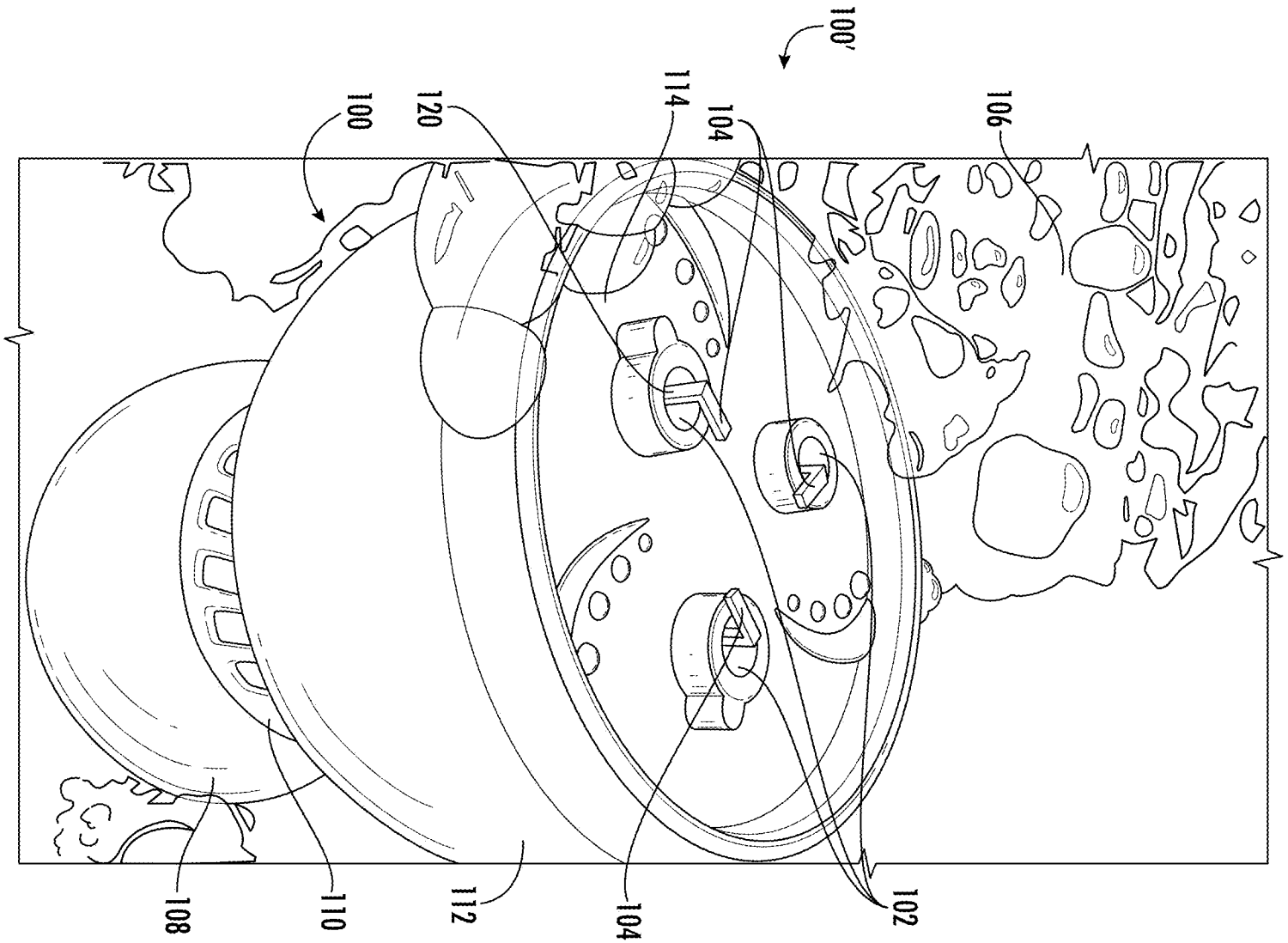
FIG. 3 shows another embodiment of the multi-port soap bubble blowing machine in accordance with the present invention in the process of blowing bubbles from multiple ports.

FIG. 3 shows the present machine in use and blowing bubbles 106 in a second embodiment 100' of the present invention, details of which will be discussed in detail below.

Figure 4A:
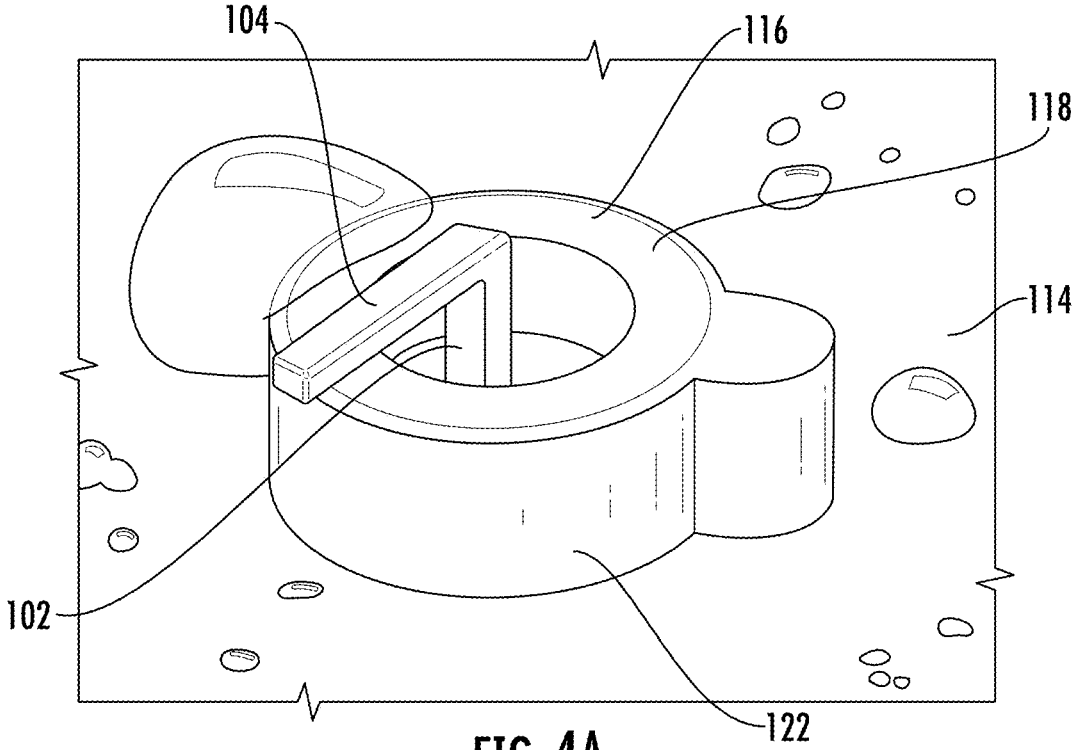
FIGS. 4A and 4B show the loading of soap bubble solution and swiping thereof to create a film for creating soap bubbles in the second embodiment of the present invention.
Figure 4B:
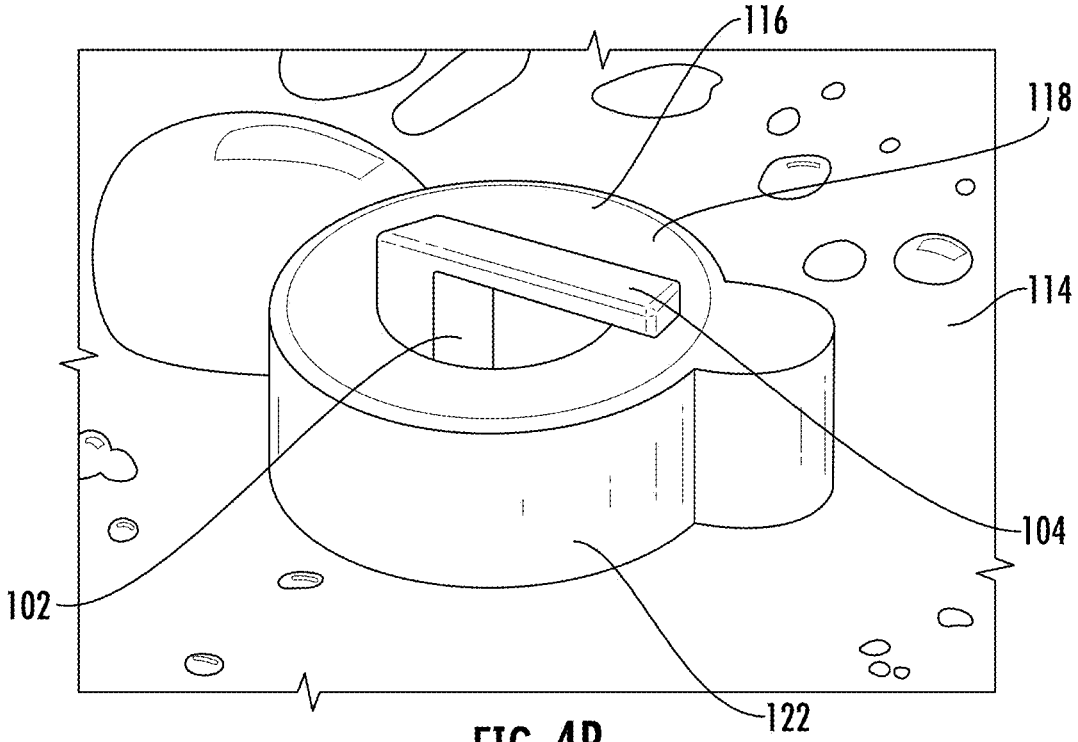

FIG. 4A shows the loading of soap bubble solution 117 to form a film 116 onto a soap bubble forming ring 118 from a feed tube, shown in FIG. 7 below, from the soap bubble solution reservoir 108. FIG. 4B shows the swiping wipers 104 to create a film 120 for creating soap bubbles 106 when air is blown through the open soap bubble ports 102. The ports 102 are positioned through a boss structure 122 that can be of any configuration. In the embodiment of FIG. 2, the boss structure 122 is large enough in plan view so that the wipers 104 rest on the top thereof at all times. In the embodiment of FIG. 3, the wipers 104 extend over the edge of boss structures 122. Otherwise, the embodiment 100 and 100' are the same in structure and configuration.

Figure 5:
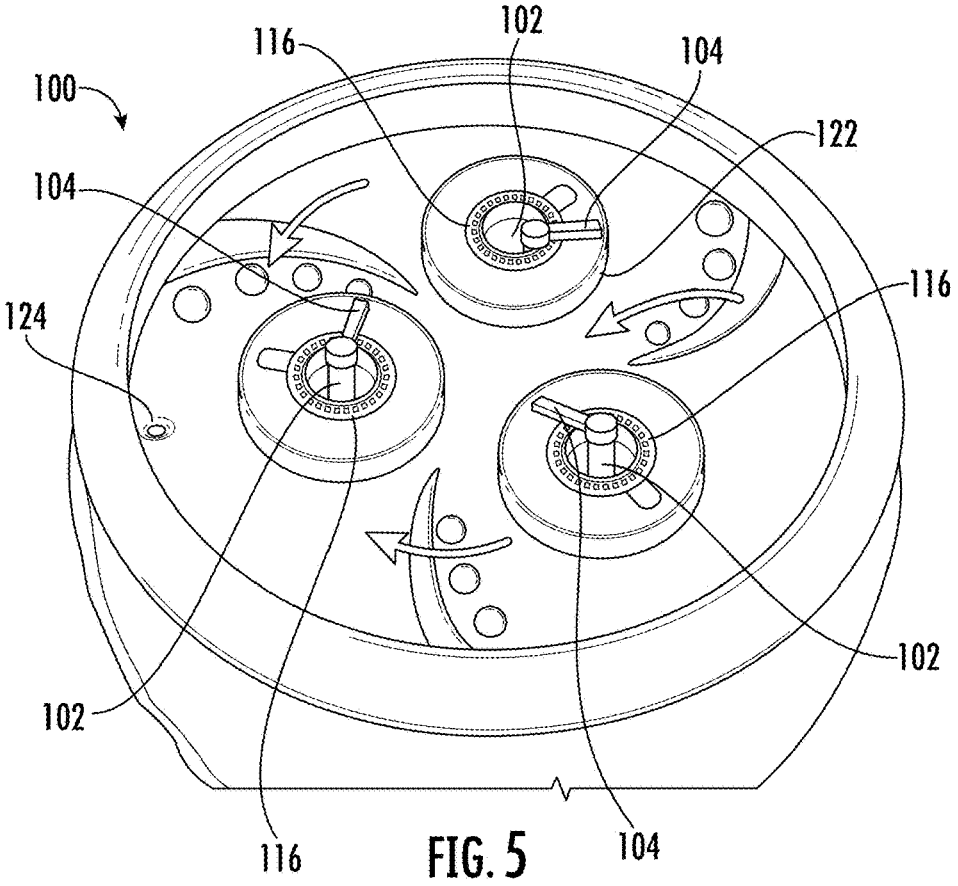
FIG. 5 is a top view of the first embodiment of the multi-port soap bubble machine of the present invention with raised bosses below the wipers to protect them.

FIG. 5 shows the first embodiment 100 of the present invention that includes optional but preferred raised boss structures 122 below the each of the wipers 104 to protect them. Thus, when the wipers 104 are rotating and continuously creating soap bubble solution film to create the soap bubbles 106, it is more difficult for a person, such as a child, to grab to wipers 104 and possibly damage them. A top plate 114 is provided with more than one soap bubble making port 102 to simultaneous create soap bubbles 106 from all of the ports 102 at the same time. A drainage or drain port 124 is provided through the top plate 114 to route excess soap bubble solution 117, as indicated by the arrows, back into the reservoir for use later 108.

Figure 6:
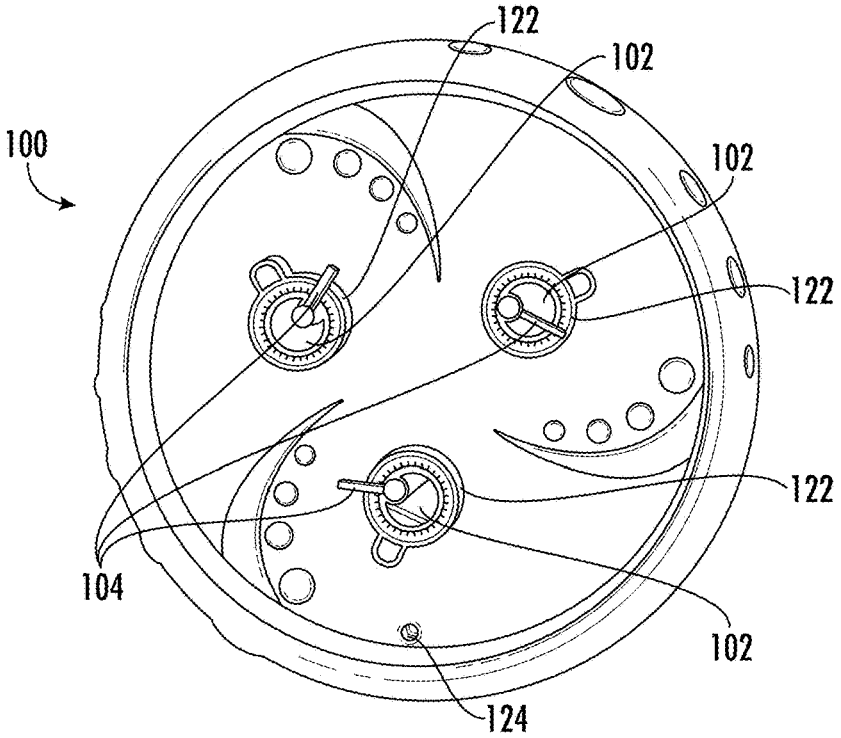
FIG. 6 is a top view of the second embodiment of the present invention.

FIG. 6 shows a top view of the slightly different embodiment 100' of the multi-port soap bubble machine of the present invention with smaller boss structures 122 surrounding each port 102 compared to embodiment 100.

Figure 18:
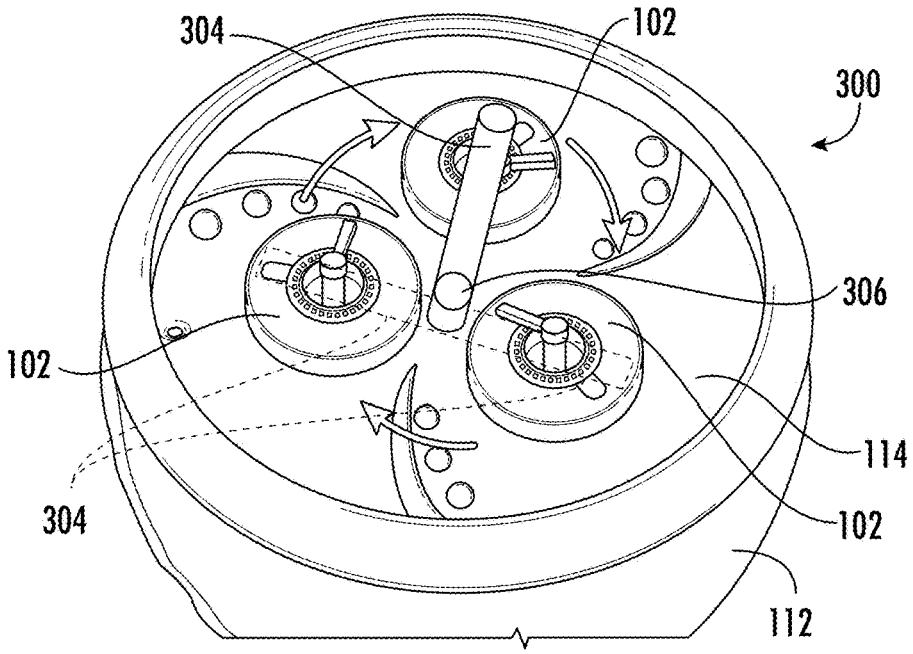
FIG. 18 is an alternative embodiment of the present invention with single wiper that wipes across all of the soap bubble ports.

In a further embodiment 200, as shown in FIG. 18, it is also possible that a singular, centrally mounted wiper or swiper 304 is provided to rotate over all of the, for example three, soap bubble ports 102 in a circular fashion about a central spindle or post 306 that is mechanically linked to the motor 150. The broken lines in FIG. 18 show how the single wiper 304 passes over each of the soap bubble ports 102 as it rotates by to create the bubble film for the creations of bubbles at each port 102. Such an embodiment can avoid additional linkages and mechanical component for multiple wipers to simplify and lower the cost of the machine.

Figure 7:
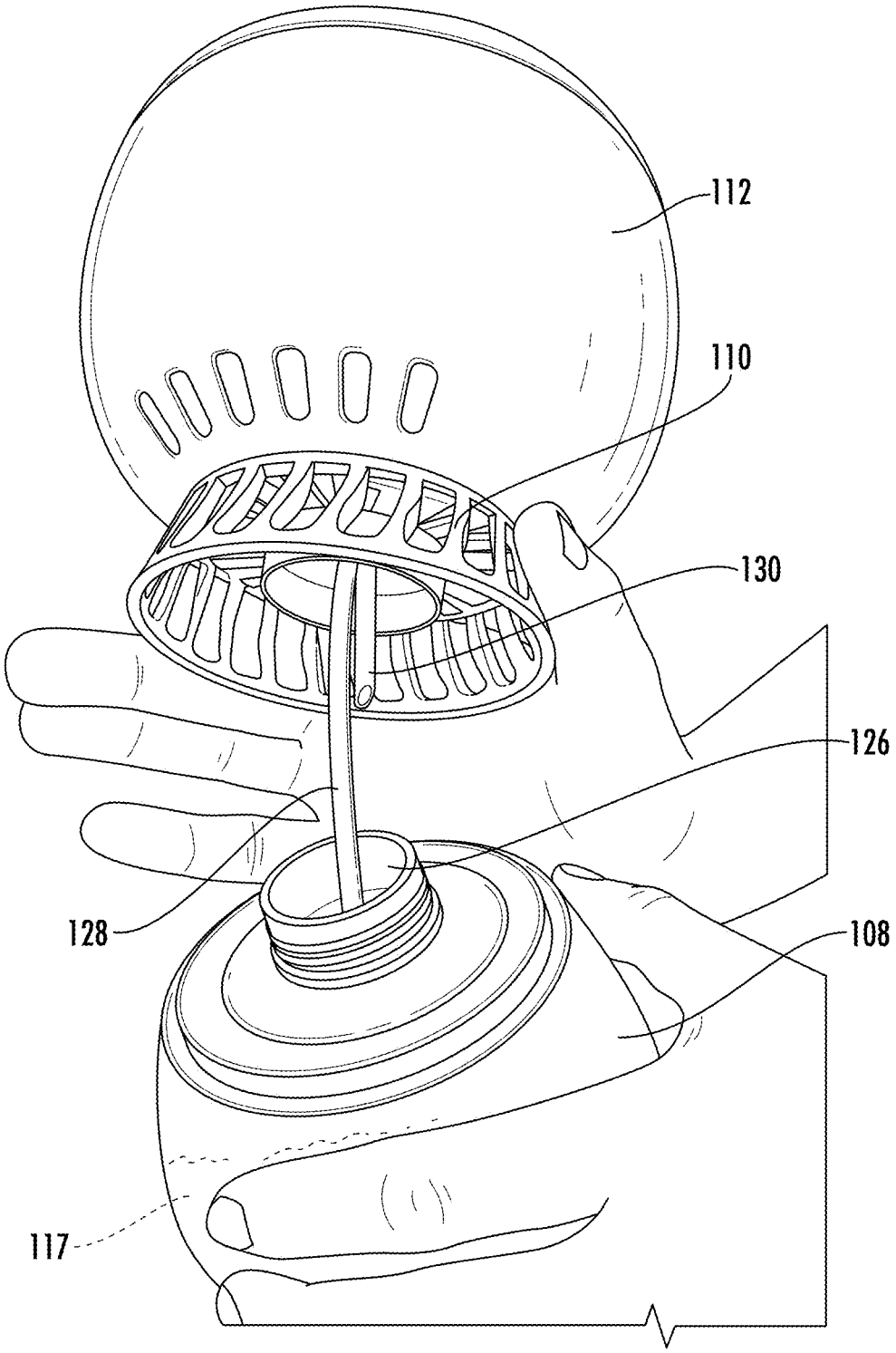
FIG. 7 shows the single dip tube in the reservoir of soap bubble solution and a return draining tube feeding unused soap bubble solution back into the reservoir.

FIG. 7 shows the machine 100/100' of the present invention showing the reservoir base 108 being threadably connected to main housing 112 with vent intake 110 disposed therebetween. FIG. 7 shows the reservoir base 108 separated from the main housing 112 to permit pouring of bubble solution through port 126 into the reservoir base 108. A single dip tube 128 in the reservoir of soap bubble solution 117 and a return draining tube 130 feeding back into the reservoir base 108 from the drainage or drain port 124 discussed above. The feed tube 128, as will be discussed in detail below, pulls soap bubble solution 117 from the reservoir base 108 by use of peristaltic pumps, as seen in the figures below. The single tube feed 128 is split into multiple supply lines to the respective multiple soap bubble ports 102.

Figure 8:
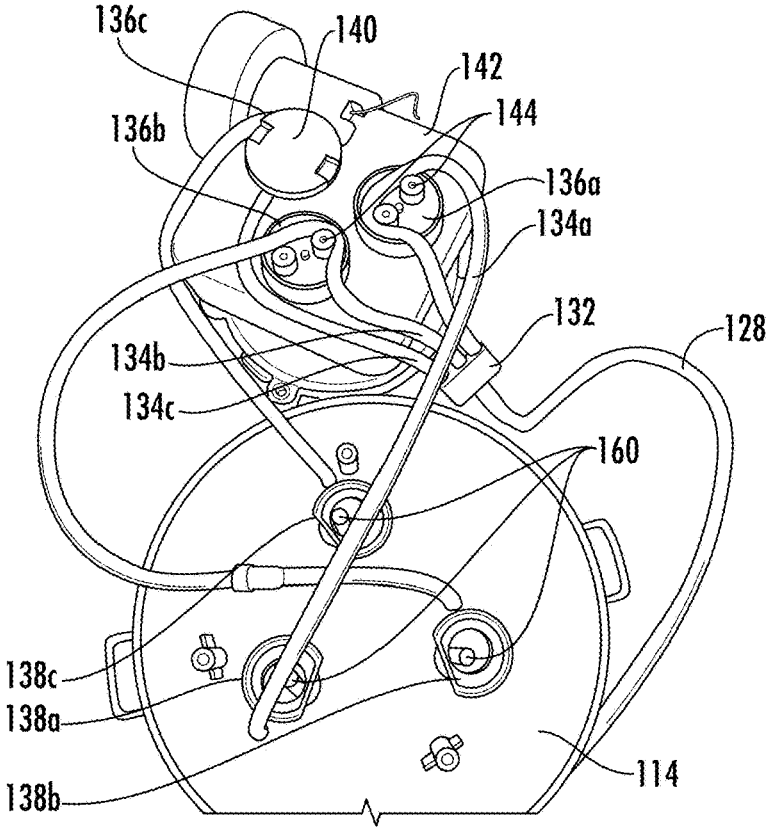
FIG. 8 is a top view of the machine of the present invention in an exploded/disassembled view, for ease of reference of the components, showing the solution feed lines, integrated peristaltic pumps and manifold.

FIG. 8 is a top view of the machine 100/100' of the present invention in an exploded condition for illustration purposes only. The components shown in FIG. 8 are installed in housing 112 with ports 102 facing upwards as in FIGS. 2 and 3.

Figure 9:
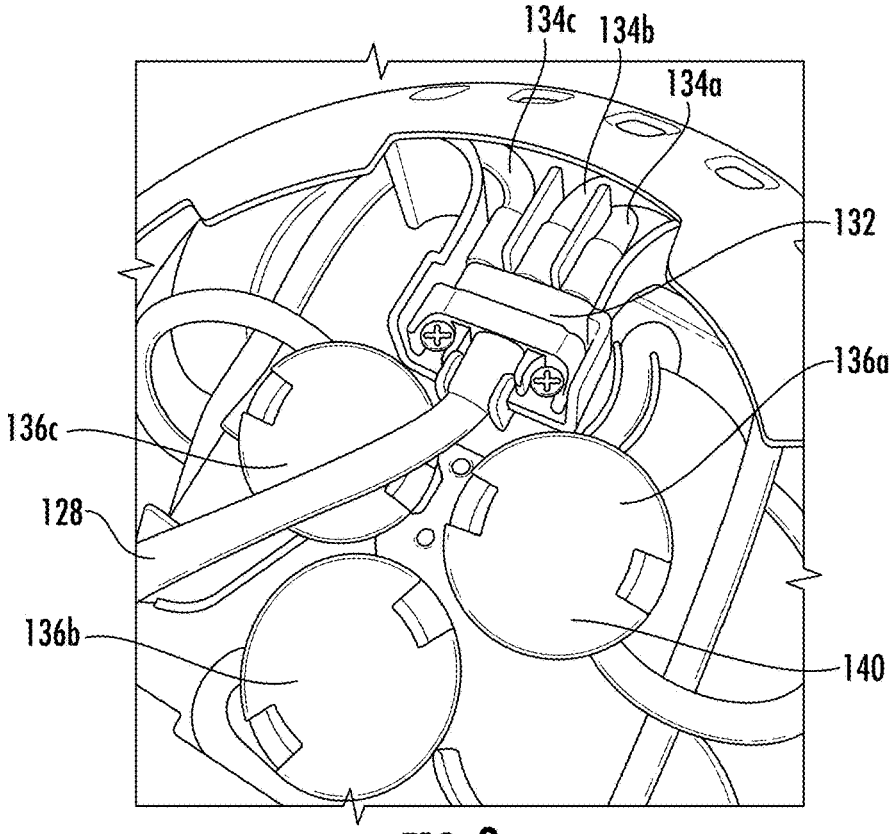
FIG. 9 shows the linking of the three pump lines together using a 1 to 3 manifold and installed in place in the housing of the machine of the present invention.

The feed tube 128 pumps bubble solution up from the supply in the reservoir base 108, through manifold 132 and then into three output lines 134*a-c* having their own inline peristaltic pumps 136*a-c* to pull soap bubble solution liquid from the reservoir base 108 up through the manifold 128 and out through the multiple solution feed lines 136*a-c* (a single input to three output manifold 128 in this example case) and then to each of the respective rings 116 at each soap bubble port 102. As can be best seen in FIG. 8, three peristaltic pumps 136*a-c*, also commonly known as roller pumps, are provided for each of the three soap bubble solution feed lines 134*a-c*, The optional protective cap 140 of two on the three pumps 136*a-c* has been removed for illustration purposes only. FIG. 9 shows the pumps 136*a-c* installed in the housing 112 with manifold mounted in place with solution feed lines 134*a-c* routed therefrom to the rings 116 about each port 102.

Pumps 136*a-c* are of type of positive displacement pump used for pumping a variety of fluids and is well-suited for pumping soap bubble solution 117. Preferably, the soap bubble solution fluid routed via one supply line 128 into a manifold 132 with one input line and, for example, three output lines 134*a-c* to accommodate three soap bubble ports 102. The manifold 132 may have two or more than three outputs to feed the appropriate number of supply lines 134*a-c* depending on how many soap bubble ports 102 need a supply of soap bubble solution from the bubble solution reservoir 108.

As can be seen, a triple peristaltic pump 136*a-c* is configured on the output side of the manifold 128, on each output feed line 134*a-c* to effectively pump (i.e., pull) soap bubble solution 117 from the feed reservoir base 108 and direct it to each of the respective soap bubble ports. Referring back to FIG. 9, further details are shown as to the 1 to 3 manifold to simultaneously supply solution to each of the three bubble ports 102. A rotor (in pump housing 142), is mechanically linked to the motor and a main rotating shaft of the motor to rotate the rollers 144 thereby compressing the flexible tube feed lines 134*a-c* as they rotate by. The part of the tube 134*a-c* under compression is closed, forcing the fluid to move through the tube 134*a-c*. Additionally, as the tube opens to its natural state after the rollers 144 pass, more fluid is drawn into the tubes 134*a-c* respectively. Preferably, there are two or more rollers 144 compressing the tube in each pump 136*a-c*, trapping a body of bubble solution fluid 117 between them. The body of fluid 117 is transported through the tubes 134*a-c*, toward the pump outlet, namely toward the soap bubble making ports 102. The multiple peristaltic pumps 136*a-c* of the present invention 100, 100' preferably run continuously but they may be configured to run intermittently, such as in indexed fashion through partial revolutions to deliver smaller amounts of fluid 117.

Figure 17:
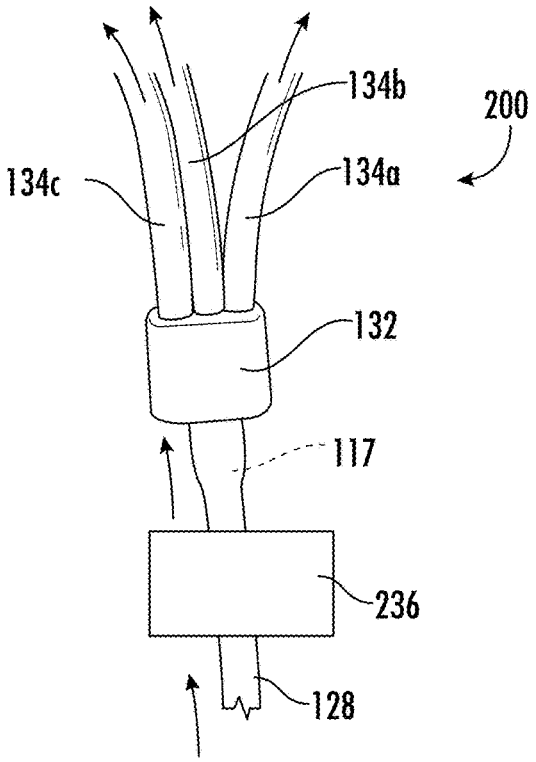
FIG. 17 shows an alternative embodiment of the use of a single pump on the single input side of the manifold.

It is also possible and contemplated by the present invention to provide, instead, a single pump, representationally shown as 236 in FIG. 17, on the input leg 128 upstream before the solution manifold 132, as shown in the alternative embodiment of 200. Such use of a single pump 236, such as a single peristaltic pump 236, in certain environments and applications may be more preferred. In that alternative embodiment 200, the single pump 236 "pushes" bubble solution 117 into the manifold 132.

Figure 10:
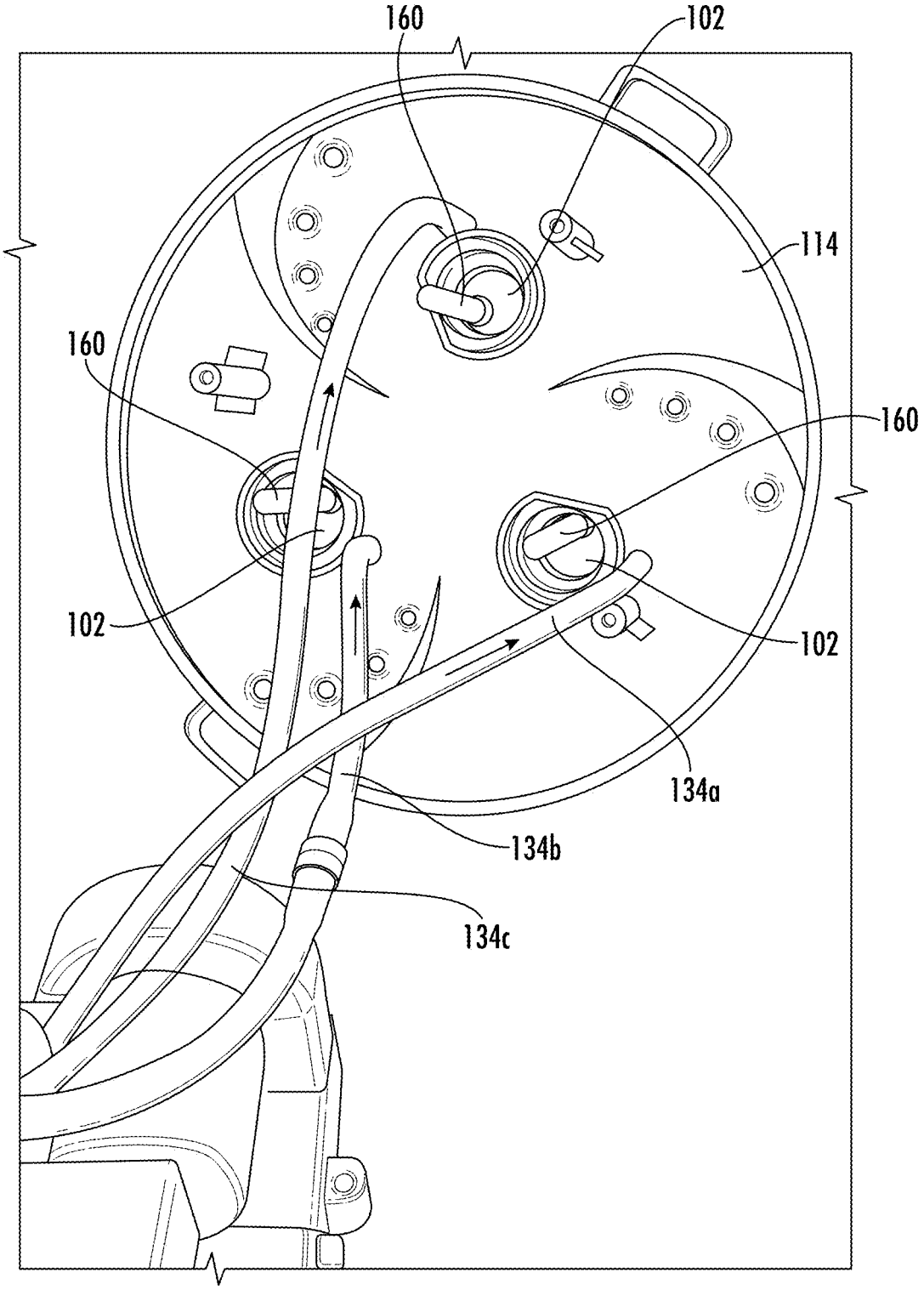
FIG. 10 shows the feed of solution supply lines to the soap bubble ports.
Figure 11:
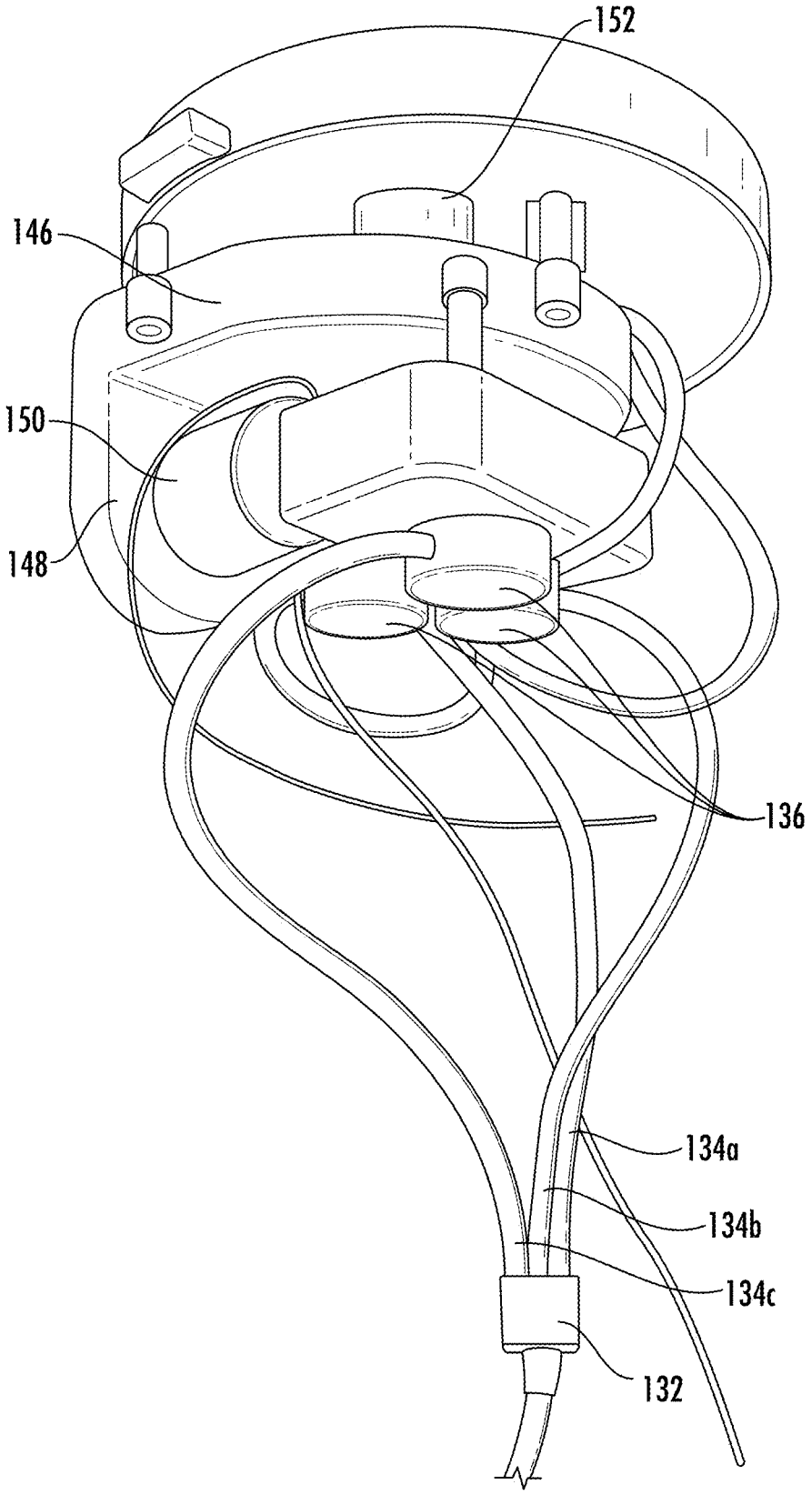
FIG. 11 shows another view of the solution supply lines to the soap bubble ports
Figure 12:
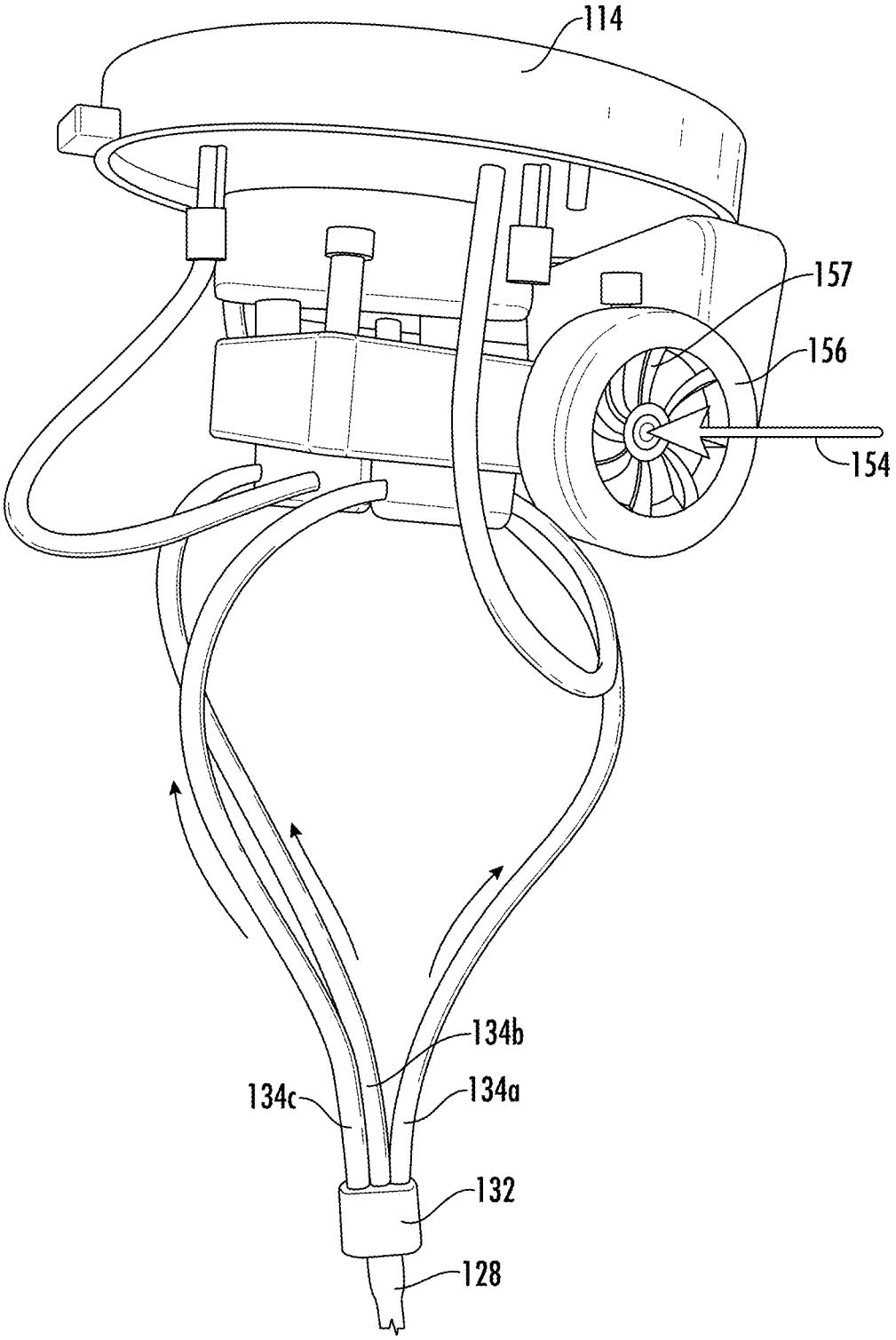
FIG. 12 shows another view of the solution supply lines with 1 input to 3 output manifold.

FIG. 11 shows yet another view of the supply lines 134*a-c* to feed soap bubble solution 117 to the rings 116 about soap bubble ports 102. FIGS. 10 and 11 shows additional views of the solution supply lines 134*a-c* to the rings 116 about soap bubble ports 102. In this view, air chamber 146 that received blown air from fan 148 that is powered by motor 150. Shaft 152 can be seen, which powers the rotation of wipers 104 that are mechanically interconnected thereto, as will be discussed below. Air 154 is pulled in through air intake 156 and then into the air manifold.

Figure 13:
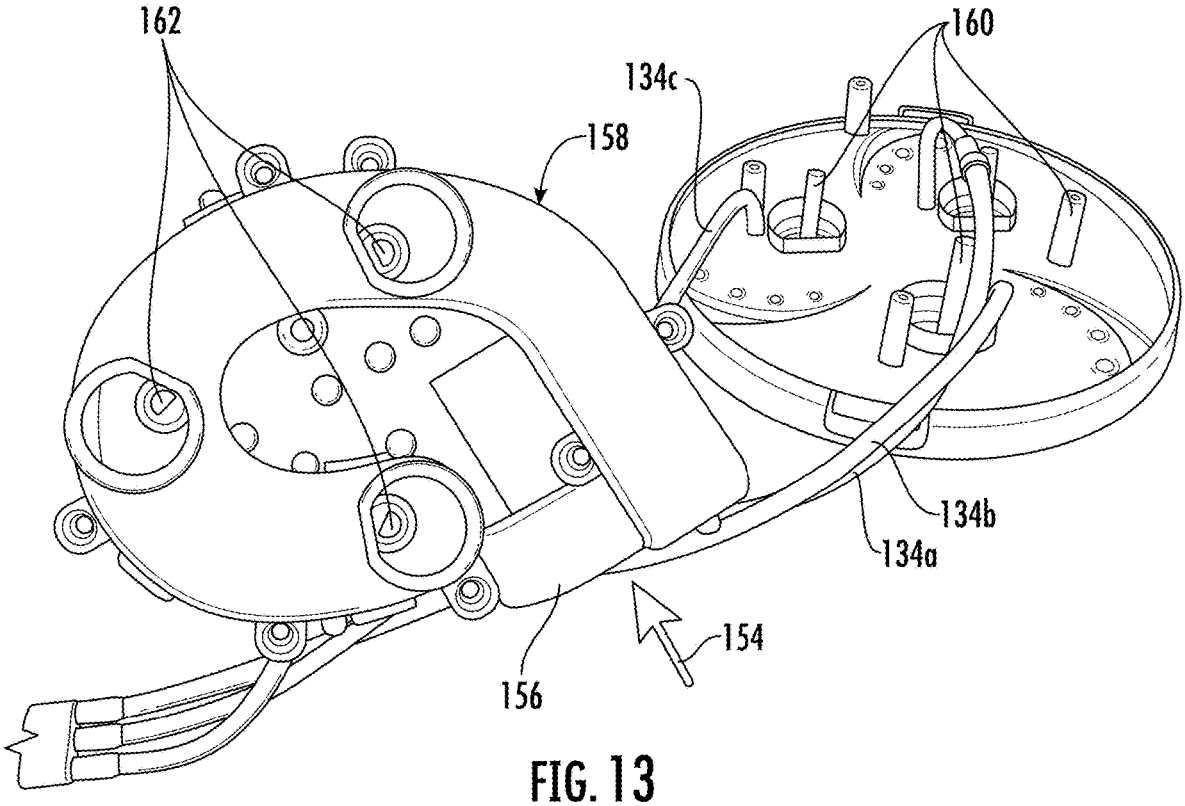
FIG. 13 shows an exploded view of the air blower and solution feed lines of the present invention.
Figure 14:
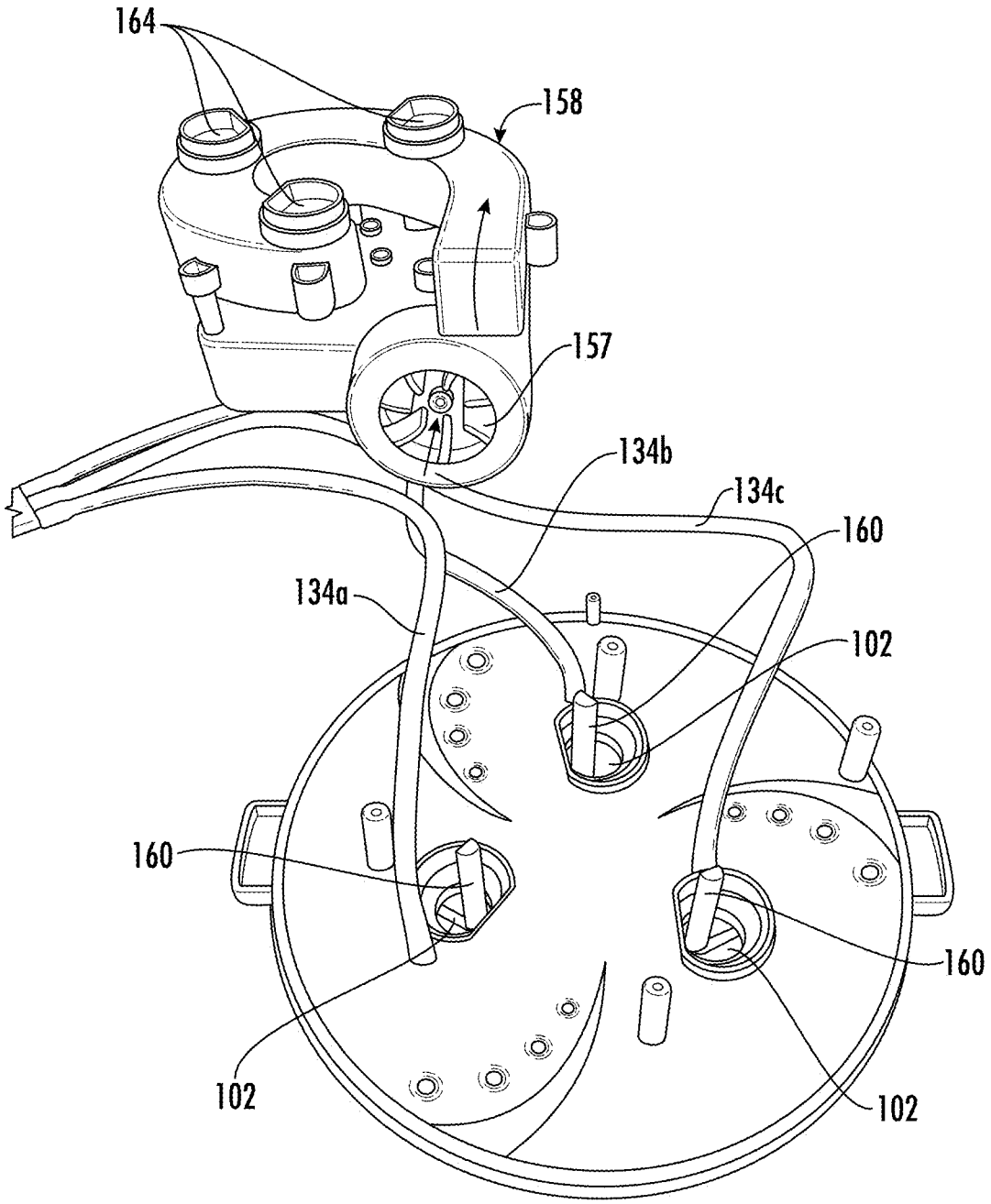
FIG. 14 shows another view of the air blower and solution feed lines of the present invention.

FIGS. 13 and 14 show views of the air blower manifold, generally at 158, and solution feed lines 134*a-c* of the present invention 100, 100' disassembled from the housing 112 for ease of view and discussion. The details of mechanical rotation of the respective wipers 104 at each soap bubble port 102 location can be seen. Each of the wipers 104 are mounted to a free end of a respective keyed rotating spindle 160 through the top plate 114 of the machine 100, 100'. As can best be seen in FIG. 13, the free ends of the keyed rotating spindles 160 respectively reside in complementary rotating seats 162 in the air blower manifold 158 when the top plate 114 is attached to the air blower manifold 158. The rotating keyed seats 162 are mechanically linked to the shaft 152 of the motor 150 so they are all driven simultaneously by the motor 150. When the top plate 114 is mated to the top of the blower manifold 158, each spindle 160 is rotatably driven by a respective one of the rotating seats 162. FIGS. 13 and 14 shows how all three spindles are simultaneously driven by the motor.

For the blowing of air through ports 102, the motor 150 is energized and the fan 157 is actuated and air is blow through air manifold 158 and out through air ports 164, which are in fluid engagement with ports 102. Thus, bubble solution film across ports 102 receives air through ports 164 for the creation of bubbles 106.

Figure 15:
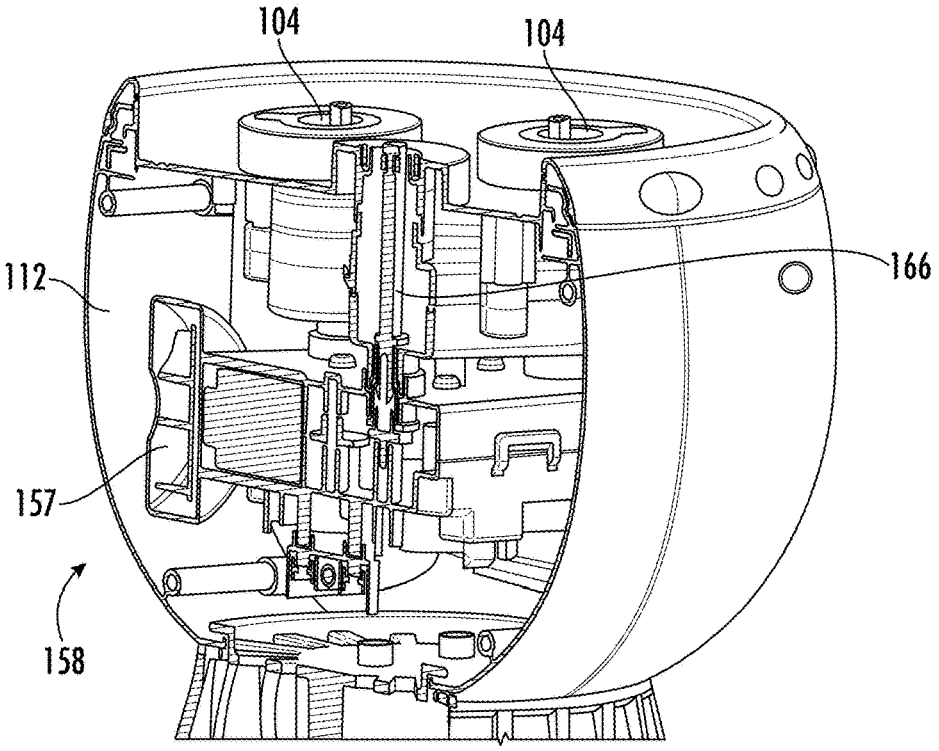
FIG. 15 shows three spindles being simultaneously driven by the motor.

For the rotation of the wipers 104, the motor 150 is interconnected to rotating seats 162 into which keyed spindles 160 resides. Thus, when the motor is energized, the seats 162 rotate thereby rotating the wipers 104 on the opposite side of the top plate 114. FIG. 15 further shows a cross-sectional view of the interconnection of the multiple spindles being driven by a single motor.

Figure 16:
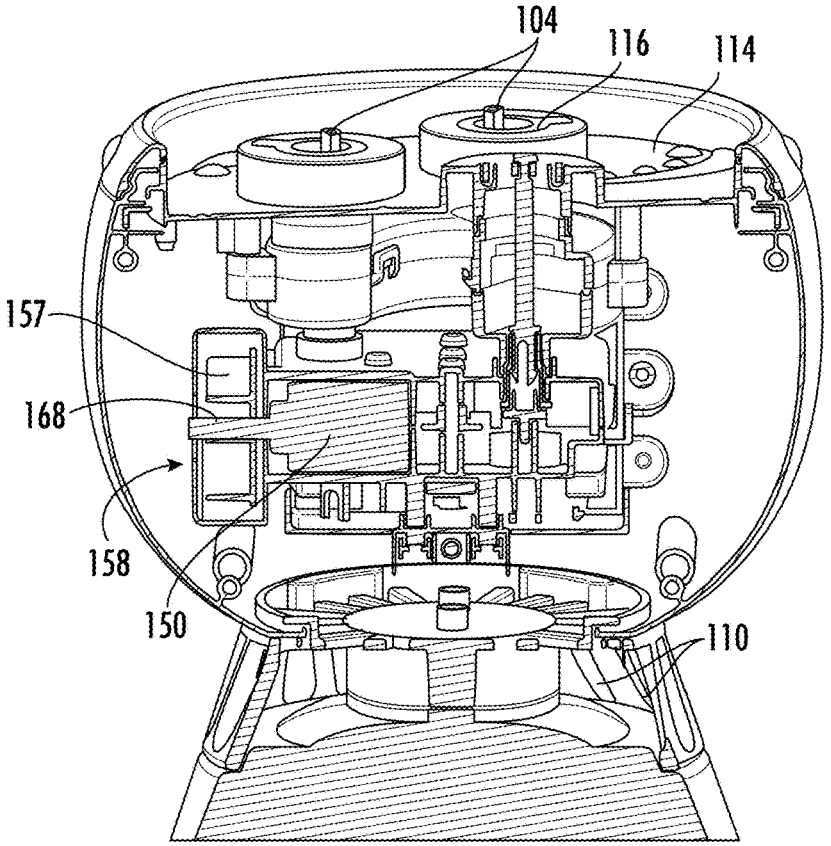
FIG. 16 shows the shaft of the blower turbine linked to the motor shaft.

As a result, a single motor 150 simultaneously provides the power to blow air to multiple ports 102, routes bubble solution 117 to each ring 116 and rotates each of the wipers 104. FIG. 16 shows how the shaft of blower fan 147 is linked to the motor 150 via motor spindle 168. Thus, this enables the motor 150 to not only power the rotation of the spindles 160 (to rotate the wipers 104) but also power the fan turbine 157 to blow air through the blower manifold 158 and then out through ports 102 that carry a bubble solution film across rings 116 and trough therein to create bubbles 106 therefrom.

FIG. 15 shows the air blower 158, in the form of a transverse rotating turbine, being mechanically linked to the shaft 166 of the motor 150. Referring back to FIGS. 12 and 14, air is blown by the turbine 157 and into the linear manifold to deliver air through each of the soap bubble ports 102. The raised wall/boss structures 122 surrounding each of the output ports 102 of the air blower manifold 158 respectively mates with the keyed walls surrounding the soap bubble ports 102 at the bottom of the top plate 114 of the machine 100, 100' to provide a sealed delivery of the air to the soap bubble ports 102. Thus, the pathway of air from the blower turbine 157 is directed more efficiently.

As can be understood, the various components shown above are assembled into a completed soap bubble machine 100, 100', as substantially shown in FIGS. 2 and 3, for example. The components of the assembled machine 100, 100' are secured in place, such as by gluing, welding, heat sealing, or the like, to provide the final working machine 100, 100' in accordance with the present invention.

In view of the above, the present invention uniquely provides a wiper type soap bubble blowing machine 100, 100' that can supply soap bubble solution 117 simultaneously to more than one soap bubble port 102 while also rotating all wipers 104 and blowing air through all soap bubble ports 102 at the same time. As a result, the soap bubble machine 100, 100' of the present invention can produce more soap bubbles 106 than previously possible with prior art devices and machines.

It should be noted that the various structural components of the soap bubble machine 100, 100' of the present invention are preferably molded plastic, silicone for the tubing for the soap bubble solution lines. The motor and other electrical components are made with materials known in the art for such motors and electrical components.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A multi-port soap bubble making machine, comprising:
- a housing;
- a motor; a shaft being rotated by the motor;
- a plurality of soap bubble making ports in the housing; each of the ports including a soap bubble outlet;
- a reservoir in a portion of the housing configured and arranged for receiving and containing soap bubble solution therein;
- at least one bubble solution pump to direct bubble solution from the reservoir to the soap bubble making ports;
- a single tube, having a first end and a second end, the first end of the tube being in fluid communication with soap bubble solution in the reservoir;
- a manifold, having at least one input port and multiple output ports; the second end of the single tube being fluidly connected to the input port of the manifold;
- a plurality of output tubes, each having first and second ends; the first ends of the output tubes respectively connected to the multiple output ports; soap bubble solution being simultaneously delivered to each of the soap bubble making ports;
- at least one wiper respectively located at each soap bubble making port whereby the at least one wiper respectively forms a film at the plurality of soap bubble making ports;
- an air blower mechanically linked to the motor;
- an air manifold, having a single input port and multiple output ports; the single input port of the manifold being in fluid communication with the air blower and the multiple output ports of the air manifold being in fluid communication with the soap bubble making ports;
- whereby rotation of the shaft by the motor delivers soap bubble solution to all soap bubble ports; rotates all of the wipers, and blows air to through all of the soap bubble ports to create multiple soap bubbles at the same time.

2. The multi-port soap bubble making machine according to claim 1, wherein the at least one wiper is a single wiper that is configured and arranged for forming a film at all of the plurality of soap bubble making ports.

3. The multi-port soap bubble making machine according to claim 1, wherein the at least one wiper is a plurality of wipers for forming a film respectively at each of the plurality of soap bubble making ports.

4. The multi-port soap bubble making machine according to claim 1, wherein the plurality of wipers are mechanically linked so they rotate together.

5. The multi-port soap bubble making machine of claim 1, wherein the at least one pump is a peristaltic pump.

6. The multi-port soap bubble making machine of claim 1, wherein the at least one pump is a plurality of pumps respectively on each of the output tubes corresponding to the plurality of soap bubble making ports.

7. The multi-port soap bubble making machine of claim 1, wherein the at least one pump is a single pump on the single tube.

8. A multi-port soap bubble making machine, comprising:
- a housing;
- a motor; a shaft being rotated by the motor;
- a plurality of soap bubble making ports in the housing; each of the ports including a soap bubble outlet;
- a reservoir in a portion of the housing configured and arranged for receiving and containing soap bubble solution therein;
- a bubble solution pump to direct bubble solution from the reservoir to the soap bubble making ports;
- at least one tube, having a first end and a second end, the first end of the at least one tube being in fluid communication with soap bubble solution in the reservoir;
- a manifold, having at least one input port and multiple output ports; the second end of the at least one tube being fluidly connected to the input port of the manifold;
- a plurality of output tubes, each having first and second ends; the first ends of the output tubes respectively connected to the multiple output ports; soap bubble solution being simultaneously delivered to each of the soap bubble making ports; and
- an air blower configured and arranged to blow air through the ports to create bubbles.

9. The multi-port soap bubble making machine of claim 8, further comprising:

at least one wiper located at each soap bubble making port whereby the at least one wiper forms a film at the soap bubble making port;

the at least one wiper being configured and arranged to create a bubble film at each port through which air is blow to create bubbles.

10. The multi-port soap bubble making machine of claim 9, wherein the at least one wiper are a plurality of wipers.

11. The multi-port soap bubble making machine of claim 10, wherein the plurality of wipers are mechanically linked so they rotate together.

12. The multi-port soap bubble making machine of claim 9, further comprising:

an air manifold, having a single input port and multiple output ports; the single input port of the manifold being in fluid communication with the air blower and the multiple output ports of the air manifold being in fluid communication with the soap bubble making ports; and whereby rotation of the shaft by the motor delivers soap bubble solution to all soap bubble ports; rotates the at least one wipers, and blows air to through all of the soap bubble ports to create multiple soap bubbles at the same time.

13. The multi-port soap bubble making machine of claim 8, wherein the air blower is mechanically linked to the motor.

14. The multi-port soap bubble making machine of claim 8, wherein the pump is a peristaltic pump.

15. The multi-port soap bubble making machine of claim 8, wherein the pump is a pump on each of the output tubes.

16. The multi-port soap bubble making machine of claim 8, wherein the pump is a pump on the single tube.

* * * * *